United States Patent [19]

Bruensicke

[11] Patent Number: 4,646,848

[45] Date of Patent: Mar. 3, 1987

[54] FIRE SUPPRESSION SYSTEM FOR AN AIRCRAFT

[75] Inventor: Wilhelm A. Bruensicke, Santa Monica, Calif.

[73] Assignee: Lockheed Corporation, Calabasas, Calif.

[21] Appl. No.: 665,406

[22] Filed: Oct. 26, 1984

[51] Int. Cl.[4] ..... A62C 35/12; A62C 13/42

[52] U.S. Cl. ..... 169/62; 169/70; 169/89; 169/74; 239/309; 244/129.2

[58] Field of Search ..... 169/30, 46, 51–54, 169/62, 70, 71, 74–76, 88, 89; 239/271, 272, 309, 569, 581, 582, 600; 244/129.2

[56] References Cited

U.S. PATENT DOCUMENTS

| | | | |
|---|---|---|---|
| 1,297,024 | 10/1918 | Smith | 169/62 |
| 1,660,992 | 7/1921 | Erwin | 169/62 |
| 1,925,669 | 9/1933 | Levy | 169/75 |
| 3,719,232 | 3/1973 | Gubela | 239/309 |
| 3,972,373 | 8/1976 | Nichols et al. | 169/62 |
| 4,351,394 | 9/1982 | Enk | 169/61 |
| 4,420,047 | 12/1983 | Bruensicke | 169/53 |
| 4,482,012 | 11/1984 | Enk et al. | 169/62 |

FOREIGN PATENT DOCUMENTS

| | | | |
|---|---|---|---|
| 879145 | 2/1943 | France | 169/74 |

*Primary Examiner*—Jeffrey V. Nase
*Attorney, Agent, or Firm*—Louis L. Dachs

[57] ABSTRACT

The invention is a fire suppression system for an aircraft 10 of the type having a main cabin compartment 12, such as a passenger compartment and a plurality of closable or closed-off subcompartments. These subcompartments can be any area which is separated by fixed structure from the main cabin and therefore are normally not accessible. The fire suppression system comprises a plurality of ducts 57 coupling a plurality of subcompartments 14, 15, 22 to the main compartment. The plurality of ducts 57 have first ends of the ducts 57 terminate in nozzles 58 within the subcompartments adapted to distribute the fire suppression chemical in a specific pattern and second ends terminating in disconnect valve halves 59 accessible from the main cabin compartment. A portable unit 30 having a tank 42 filled with a fire suppression chemical under pressure is moveable within the main compartment 12. Preferably, the fire suppression chemical is Halon stored under nitrogen gas pressure. The unit 30 has a length of flexible line 54 coupled to the tank 42 and terminating in a nozzle assembly 55 having a disconnect valve half 159 mounted thereon. This disconnect valve half 159 is connectable to the disconnect valve half 59 attached to any one of the ducts 57.

5 Claims, 12 Drawing Figures

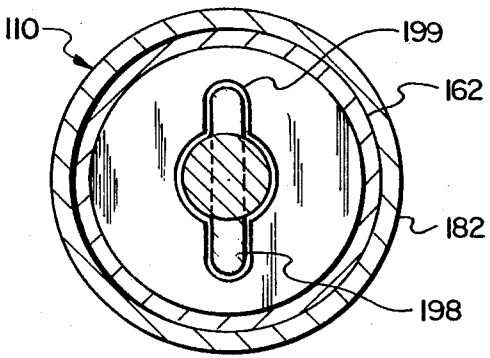
Fig. 4.b.
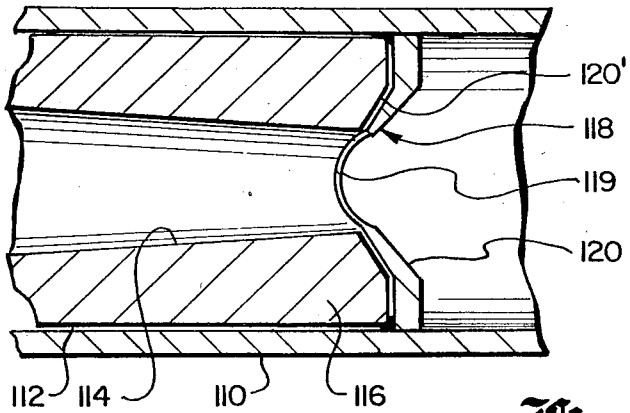
Fig. 4.a.
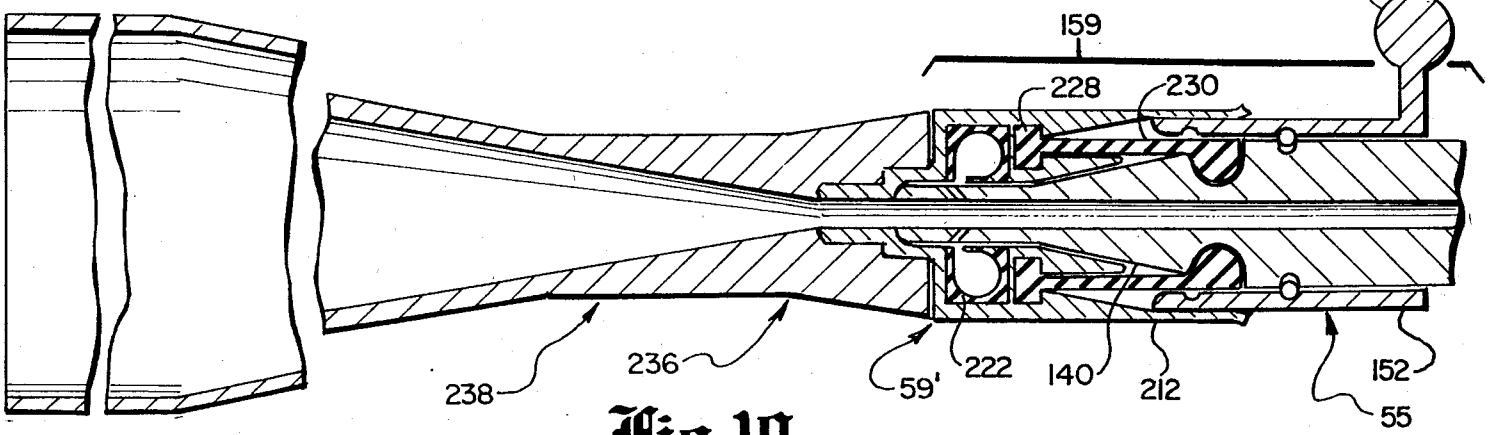
Fig. 11.

FIRE SUPPRESSION SYSTEM FOR AN AIRCRAFT

TECHNICAL FIELD

The invention relates to the field of fire-fighting equipment and, in particular, to a fire suppression system for use on aircraft which can effectively suppress fires within inaccessible as well as accessible areas.

BACKGROUND INFORMATION

A great many methods and substances exist to fight fires. When dealing with fires aboard aircraft, buses, trains, etc., large amounts of water are generally not available and portable containers of fire suppression chemicals are carried. These containers are usually filled with $CO_2$ or Halon compounds (for example, bromochlorodifluoromethane or bromotrifluoromethane). Their effectiveness depends upon the type of fire which is to be suppressed. For example: water, $CO_2$, and some dry chemicals are effective on burning wood and paper fires (Class "A"). Halon compounds are suitable for use on fires caused by flammable fluids (Class "A" and Class "B"), and electrical origin fires (Class "C").

The instant invention is primarily concerned with extinguishers using fire suppression chemicals such as Halon compounds. For example, Halon compounds are the principal fire suppression chemicals used in aircraft jet engine nacelles, APU installations, and selected cargo compartments as well as other designated high-fire-risk areas. Unfortunately, due to the high cost and weight of fixed suppression system installations, there are numerous cargo compartments and other inaccessible areas of the aircraft which are not so equipped.

In those areas which are accessible, such as the cabin proper, lavatories, and galleys, etc., fire protection depends upon the use of small, limited-capacity, hand-held extinguishers. Because of their limited capacity, they are not always totally effective in suppressing such fires. An improvement to the hand-held-type extinguisher is disclosed in Applicant's U.S. Pat. No. 4,420,047, "Stowable Fire Suppression System for Aircraft Cabins and the Like". Here, a portable cart containing a tank filled with foam generating chemical is connectable to the aircraft's water supply system to provide fire suppressing foam. Thus, the limited capacity problem is solved. For the aforementioned inaccessible compartments and areas, it would be very desirable to have the capability of "flooding" them with Halon compounds, thereby providing the most effective fire suppression available.

Another patent of interest is U.S. Pat. No. 3,972,373, "Fire Extinguisher System for a Vehicle" by K. B. Nichols, et al. Nichols, et al. disclose a system wherein a hand-held fire extinguisher stored within the passenger compartment of a motor home can be connected from the exterior thereof to a manifold within the engine compartment to fight a fire therein. Such a system is unsuitable for use on an aircraft since there is limited fire-fighting capacity in a hand-held extinguisher. Furhtermore, the fire extinguisher is connected to the engine compartment from an external connection and not from within the passenger compartment, making the system unuseable in flight. Additionally, there is no disclosure of a long-term storage fluid isolation system, and means to precisely regulate the delivery of the fire suppression chemical.

Therefore, it is a primary object of the subject invention to provide a fire suppression system, wherein both accessible and inaccessible compartments aboard an aircraft can be provided with effective fire suppression chemicals.

It is another object of the subject invention to provide a fire suppression system that can provide fire suppression chemicals to both accessible and inaccessible compartments using a singl source of fire suppression chemical.

It is a further object of the subject invention to provide a portable fire suppression system which can be moved throughout the main compartment of the aircraft to fight localized fires therein, as well as those in inaccessible areas above and below the main compartment.

DISCLOSURE OF INVENTION

The invention is a fire suppression system for an aircraft of the type having a main cabin compartment such as a passenger compartment and a plurality of subcompartments separated from the main cabin by fixed structures. These subcompartments can be cargo areas, hydraulic and electrical service centers, ceiling areas, and cheek cavities, etc., in the cargo compartments.

The fire suppression system includes a plurality of ducts coupling the plurality of subcompartments to the main compartment. Each duch has first and second ends with the first end terminating in a first disconnect valve half accessible from the main cabin compartment. The second end of the ducts terminates in a nozzle(s) assembly within the subcompartment adapted to discharge the fire suppression chemical into the designated area.

A portable unit having a tank filled with a fire suppression chemical under pressure is moveable within the main compartment. Preferably, the fire suppression chemical in Halon, stored under nitrogen gas pressure. The unit has a length of flexible hose coupled to the tank terminating in a nozzle assembly to which is mounted a second disconnect valve half, connectable to the first disconnect valve half, attached to the passage means. The nozzle assembly can also be coupled to a nozzle extension so that it can be used to discharge the fire suppression chemical within the cabin compartment. An actuation means in the nozzle assembly provides flow rate control.

Thus, should a fire in a subcompartment occur, the portable unit can be moved to the location of the first disconnect valve half of the passage means connected to that subcompartment, wherein the second disconnect valve half can be coupled to the first half so that pressurized fire suppression chemical can be injected into the subcompartment.

The novel features which are believed to be characteristic to the invention, both as to its organization and method of operation, together with further objects and advantages thereof, will be better understood from the following description connected with the accompanying drawings in which a presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

Illustrated in FIG. 1 is a cross-sectional view of a typical transport aircraft fuselage showing the fire suppression system including a portable unit containing fire suppression chemical installed therein.

Illustrated in FIG. 2 is a side-elevation view of a portable unit.

Figure 2:
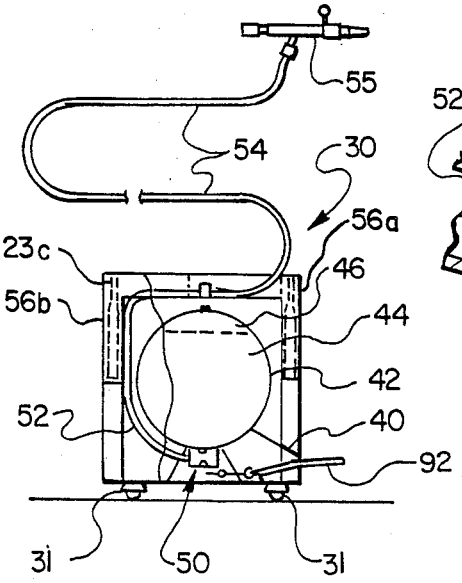
Figure 3:
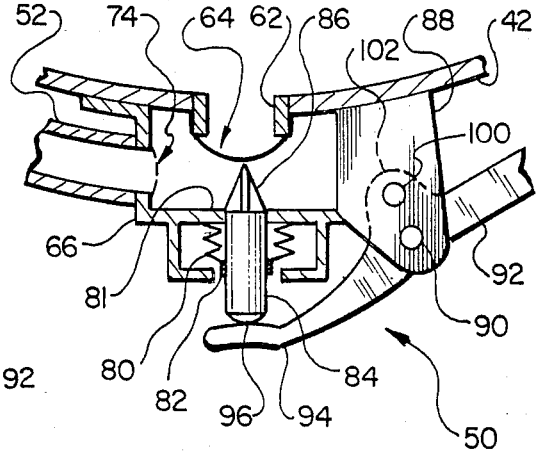

Illustrated in FIG. 3 is an enlarged cross-sectional view of the lower portion of a tank mounted in the portable unit shown in FIG. 2.

Figure 4:
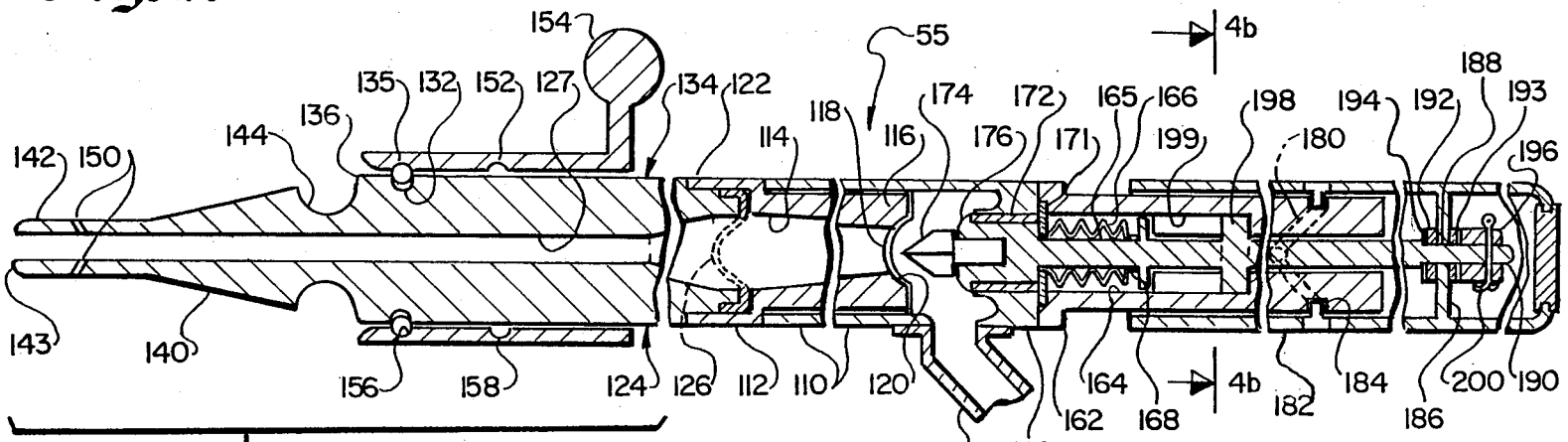

Illustrated in FIG. 4 is an enlarged cross-sectional view of the nozzle assembly of the portable unit shown in FIG. 2 and having a disconnect valve half mounted thereon.

Illustrated in FIG. 4*a* is an enlarged view of a portion of the nozzle assembly shown in FIG. 4.

Illustrated in FIG. 4*b* is a cross-sectional view of the nozzle assembly shown in FIG. 4 taken along the line 4*b*—4*b*.

Figure 5:
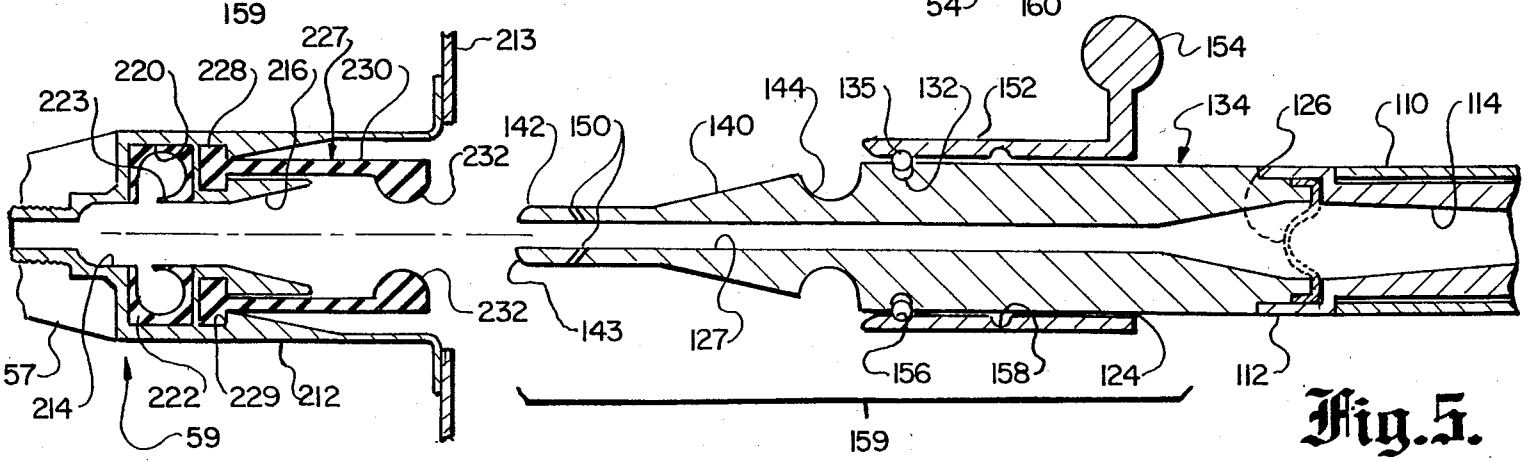

Illustrated in FIG. 5 is an enlarged partial cross-sectional view of the front portion of the nozzle assembly shown in FIG. 4, together with the disconnect valve half in axial alignment, but disengaged.

Figure 6:
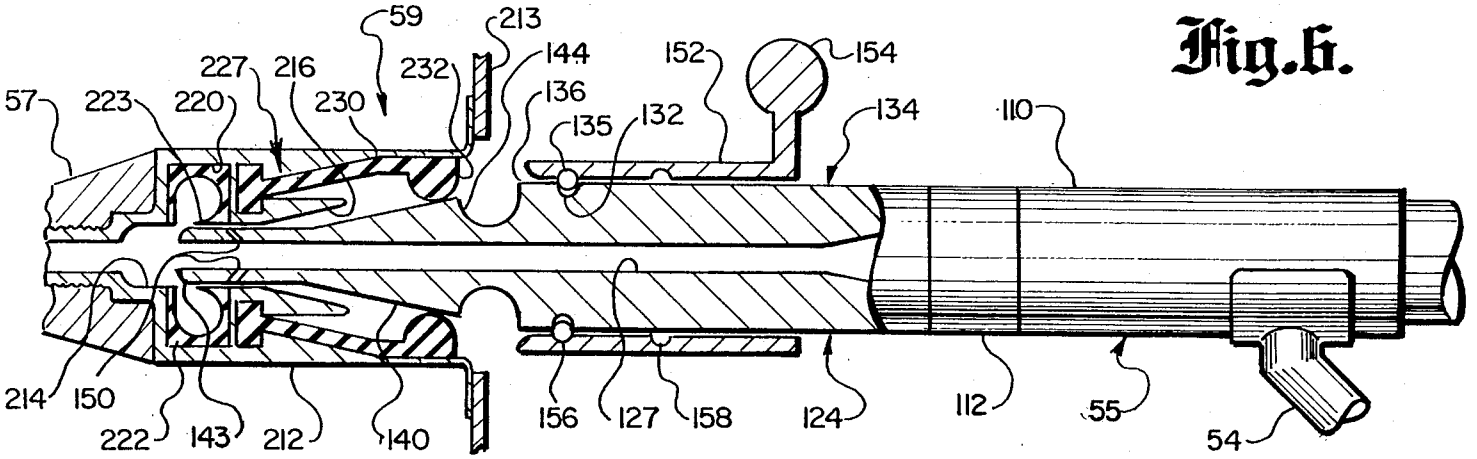

Illustrated in FIG. 6 is an enlarged partial cross-sectional view of the front portion of the nozzle assembly shown in FIGS. 4 and 5, but partially engaged with the a disconnect valve half mounted in the cabin wall.

Figure 7:
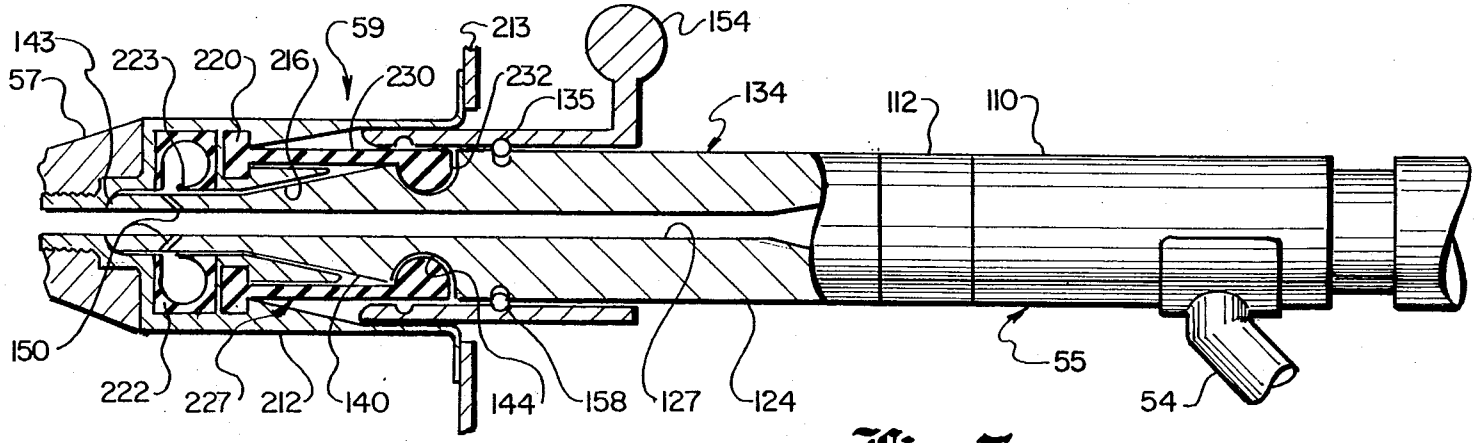

Illustrated in FIG. 7 is the same structure shown in FIG. 6, but with the front portion of the nozzle completely engaged with the disconnect valve half.

Figure 8:
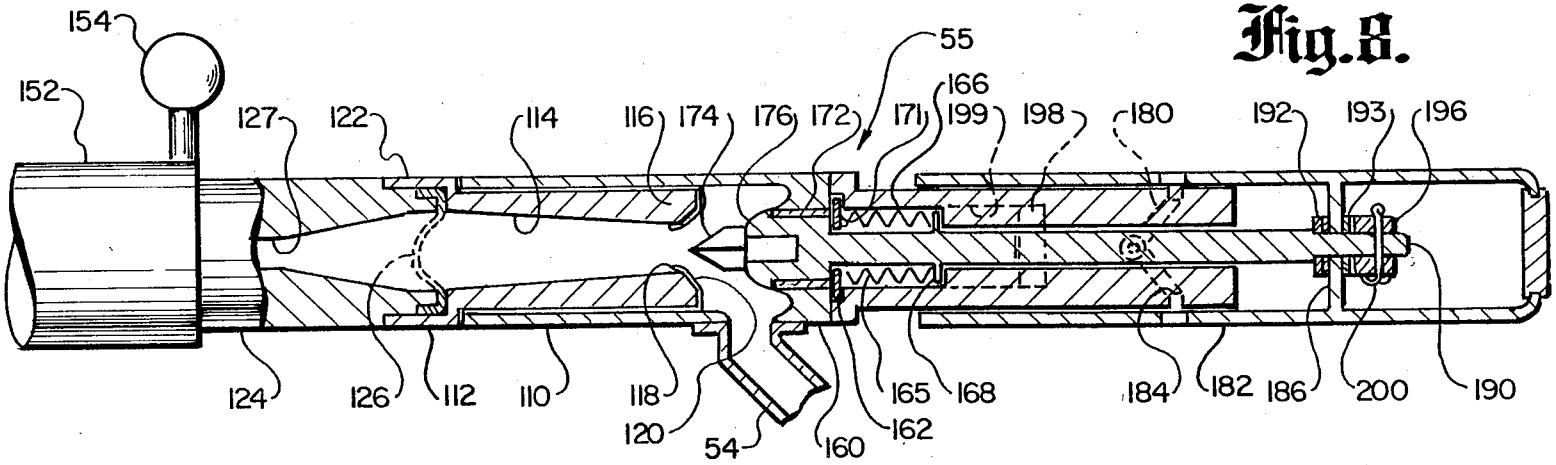

Illustrated in FIG. 8 is an enlarged partial cross-sectional view of the middle portion of the nozzle of FIG. 4, shown in the open position.

Figure 9:
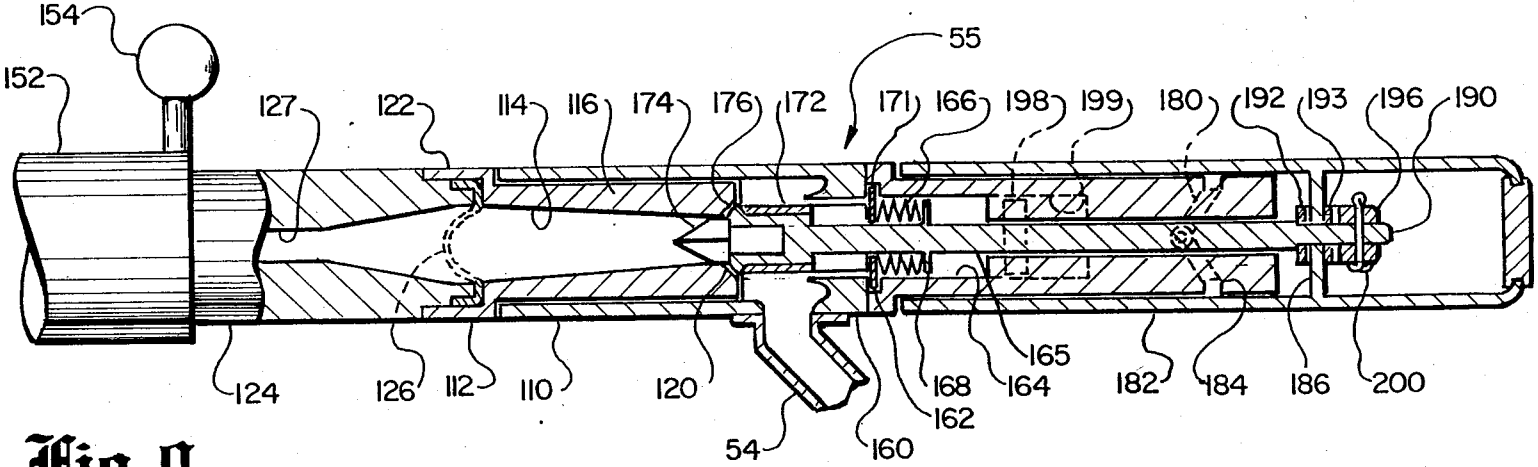

Illustrated in FIG. 9 is an enlarged partial cross-sectional view of the middle portion of the nozzle of FIG. 4, shown in the closed position.

Illustrated in FIG. 10 is a partial cross-sectional view of the front portion of the nozzle assembly shown in FIG. 4 with a nozzle extension attached thereto.

BEST MODE FOR CARRYING OUT THE INVENTION

Figure 1:
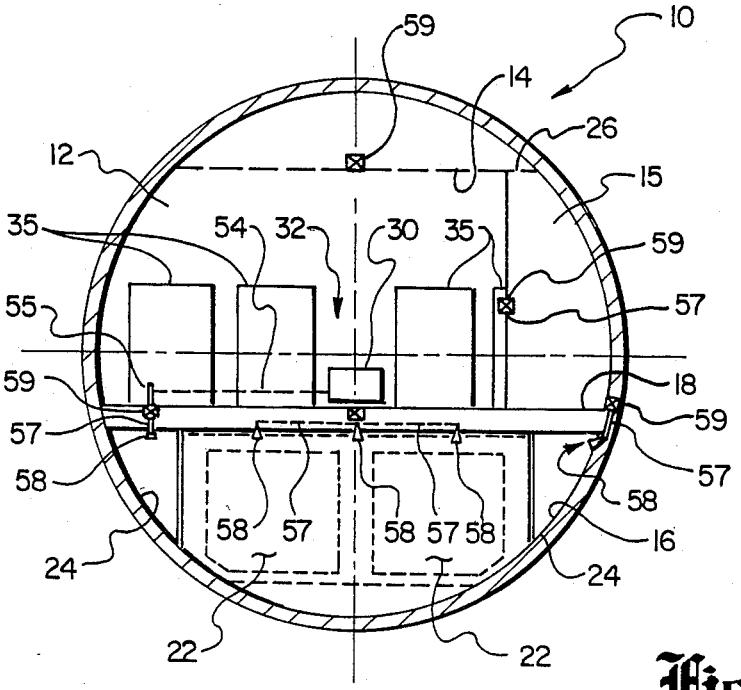

Referring to FIG. 1, it can be seen that an aircraft, generally designated by numeral 10, comprises a passenger compartment 12 having an overhead section 14 and lavatory 15. The overhead section 14 typically incorporates environmental control system ducts, wiring, etc. (not shown). The cargo compartment 16 is located below the floor 18 and may be adapted to hold bulk cargo or cargo containers 22. Additionally, the "cheek" areas 24 usually contain significant parts of the aircraft's essential systems, such as pneumatics, electrics, hydraulics, and controls, etc. (not shown).

Generally, the engine nacelles, APU compartments, and some hydraulic bays and cargo compartments are protected by self-contained Halon fire suppression systems. These self-contained systems as well as the hand-held fire extinguishers within the cabin are not available for the protection of the previously indicated inaccessible areas. Clearly, the cost and weight of adding self-contained systems for protection of these areas would be prohibitive.

The subject invention, on the other hand, is capable of providing fire suppression chemicals to any area of the aircraft likely to have a fire, while obtaining a significant overall weight reduction. The basic concept is to provide a portable supply of fire suppression chemical moveable along the passenger compartment of the aircraft which can be connected to ducting coupling the passenger compartment to the area (subcompartment) to be protected.

Still referring to FIG. 1 and additionally to FIG. 2, it can be seen that the fire suppression system comprises a portable unit 30, mounted on rollers 31, typically, sized to be moved along the aisle 32 between the passenger seats 35. The unit 30 further includes a frame 40 supporting a tank 42 filled with Halon compound 44 which is pressurized with an inert gas 46 such as nitrogen. A tank-opening mechanism 50, which will be subsequently described in detail, is attached to the bottom of the tank 42. Connected to the mechanism 50 is an outlet line 52 which, in turn, couples to a storable flexible line 54. The line 54 is connected to a nozzle assembly 55, storable in slot 56*a* (shown as dotted lines).

Referring particularly to FIG. 1, a passage means in the form of ducts 57 connects the overhead section 14, lavatory 15, cargo compartment 16, and all other subcompartments where fire suppression capability is desired, to the passenger compartment 12. The ducts 57 have first ends, each terminating in a nozzle 58 for injecting fire suppression chemicals into the subcompartments and second ends terminating in first disconnect valve halves 59. Note that an individual duct 57 may have more than one nozzle attached at its first end.

Referring now to FIG. 3, which is an enlarged partial cross-sectional view of the bottom of the tank 42, it can be seen that the tank incorporates a port 62 at its bottom, sealed by a dome-shaped diaphragm 64. Joined to the external surface of the tank 42 and surrounding the diaphragm 64 is a housing 66 to which is coupled the outlet line 52. A screen 74 covers the entrance to the line 52, preventing any fragments from entering therein when the diaphragm 64 is pierced. A seal assembly 80, consisting of a plurality of joined flexible diaphrgms, is attached to the housing 66 at its first end 81 and at its opposite or second end 82 to a ram 84. The ram 84 includes a plurality of cruciform cutters 86 for piercing diaphgram 64.

Also attached to the tank 42 is a clevis 88. Pivotally mounted to the clevis 88 via pin 90 is a foot-operated lever 92 having an arm portion 94 in contact or near contact with a lower end 96 of the ram 84. The lever 92 is prevented from moving by a pin 100 removeably mounted in a hole extending through the clevis 88 and an ear portion 102 of the lever 92. Removal of the pin 100 and depression of the lever 92 will cause the arm portion 94 to drive the ram 84 upwards so that the cutters 86 pierce the diaphragm 64, allowing the pressurized Halon to enter the line 52. Note that the seal assembly 80 prevents leakage of the Halon from the housing 66.

Referring now to FIGS. 4, 4*a*, and 4*b*, it can be seen that the nozzle assembly 55 includes a hollow housing 110 to which the flexible line 54 is coupled. A diaphragm mounting member 112 having a conical-shaped internal bore 114 telescopically engages the housing 110. Mounted on and welded to a first end 116 of the member 112 is a diaphragm assembly 118. The diaphragm assembly 118 includes a valve seat 120 which confomrs to a valve seat support 120′ at the first end 116 (best seen in FIG. 4*a*). The diaphragm assemmbly 118 further includes a thin center section 119 which, while being able to withstand the force generated by the pressurized Halon, is easily "broken away" when pierced.

A discharge nozzle member 124 is coupled to the end 122 of the member 112. Sandwiched therebetween is a screen 126 adapted to catch fragments from the center section 119 of diaphragm assembly 118 when it is pierced. The discharge nozzle member 124 incorporates a duct 127 whereby the Halon compound exits from the nozzle assembly 55.

The discharge nozzle member 124 further includes a circular groove 132 on its outer surface 134 in which is mounted a split spring ring 135, i.e., a ring made of spring material having a portion of its circumference removed so that its diameter can be compressed. The outer surface 134 further tapers inward at a point 136, a discrete distance from the groove 132, forming a conical surface 140. The surface 134 terminates in a constant diameter portion 142 at the end 143. A second and larger groove 144 is located on the conical surface 140, starting at point 136. A plurality of holes 150 connect the duct 127 to the exterior of portion 142 (their purpose will be subsequently discussed).

Slidably mounted on the surface 134 of the discharge nozzle member 124 (over the groove 132) is a sleeve 152 having a handle 154 attached thereto. The sleeve 152 further incorporates internal first and second circumferential grooves 56 and 158, respectively. As illustrated, groove 156 engages ring 135 which releasably holds the sleeve 152 in place (a first position). It can be readily seen that a forward (left push on the handle 154 will cause the sleeve 152 to compress the ring 135 into groove 132 and move over the groove 144 and conical surface 140 until groove 158 is aligned with the ring 135, allowing the ring to again expand. Thus, the sleeve 152 is again releasably locked in place (a second position). The discharge nozzle member 124, sleeve 152, and ring 135 form a disconnect valve half, indicated by bracket 159 (the operation of which will be subsequently described).

Coupled to the opposite end 160 of housing 110 is a hollow tubular member 162. A shaft 165 is moveably mounted within a bore 164 of member 162. A diaphgram seal assembly 166 (similar in construction to seal assembly 80) is attached by one of its ends 168 to the shaft 165, while the opposite end terminates in a flange 171 clamped between housing 110 and member 162. The shaft 165 has a first end 172 which incorporates a plurality of cruciform cutters 174 with a chamfered sealing surface 176 thereabout.

The member 162 incorporates peripherial cam tracks 180. A hollow, tubular member 182 serving as a hand grip is rotatably and slidably mounted about the member 162 and incorporates internally extending cam pins 184 which engage the cam tracks 180. The hand grip 182, further, incorporates a radially extending internal flange 186 having an aperture 188 therethrough. An end portion 190 of the shaft 165 is necked down and threaded. It is fixed axially with respect to internal flange 186 by means of washers 192 and 193, on either side of the flange 186 (with washer 192 abutting shoulder 194 on shaft 165), and nut 196. The nut is prevented from rotating by cotter pin 200. The shaft 165 incorporates a pair of radially extending bars 198 which extend into mating longitudinal slots 199 in the housing 162 (best seen in FIG. 4*b*). Preferably, member 162, the housing 110, and the member 112 are welded together to form hermetic seals therebetween. The actual operation of the nozzle assembly 55 will be subsequently discussed.

Referring now to FIG. 5, the disconnect valve half 59 comprises a housing assembly 212 mounted to the cabin wall 213. The housing includes a passageway 214 terminating in an internal conical surface 216 which is adapted to mate with the conical surface 140 of the discharge nozzle member 124. The housing assembly 212 further includes an internal groove 220 in which is mounted a pressure seal 222 having a sealing lip 223. A retaining member 227 is mounted within the housing 212 by means of a ring member 228 attached thereto mounted and bonded within another groove 229. The retaining member 227 also includes a plurality of flexible fingers 230 coupled to the ring member 228, each finger terminating in a rounded inwardly directed protrusion 232. The protrusions 232 are adapted to mate with the groove 144 in the discharge nozzle member 124. Typically, the retaining member 227 would be made from a reinforced rubber.

Referring to FIG. 6, which illustrates the second half of the disconnect valve 159 partially engaged in the disconnect valve half 59, it can be seen that as the nozzle assembly 55 is aligned with the bore 214 and the end 143 is inserted therein, the flexible fingers 230 are spread apart as the protrusions 232 ride "up" the conical surface 140 of the discharge nozzle member 124. As illustrated in FIG. 7, further insertion of the end 143 into the bore 214 will cause the groove 144 to become aligned with the protrusions 232, allowing the protrusions to "drop" therein and the flexible fingers 230 to return to their original position. At this point, the holes 150 of the end 143 are aligned with the interior of the hollow seal 222. Thereafter, sleeve 152 slides forward so that the groove 158 is aligned with the ring 135 and, thus, the sleeve 152 extends about the flexible fingers 230, preventing the protrusions 232 from withdrawing from the groove 144, and locking the disconnect valve halves 59 and 159 together. To disengage the nozzle assembly 55 from the disconnect valve half 59, the procedure is reversed, i.e., the sleeve 152 is moved back from about the flexible fingers 230 and a backward pull on the nozzle assembly 55 will cause the protrusions to ride out of the groove 144, freeing the nozzle assembly 55.

Referring now to FIG. 8, with the nozzle assembly 55 engaged with the disconnect valve half 59 (as shown in FIGS. 5–7), the nozzle assembly can be opened to the position shown by turning the hand grip 182 clockwise. By doing so (and postulating that the diaphargm 64 shown in FIG. 3 has been previously pierced), the internal cam pins 184 travel forward in the cam tracks 180, causing the hand grip 182 as well as the shaft 165 to move forward. The bar 198 translating within slot 199 prevents shaft 165 from rotating, thereby converting helical motion of hand grip 182 into axial motion of the shaft 165. The cutters 174 mounted at end 172 of the shaft 165 will pierce the center section 119 of the diaphragm assembly 118, allowing Halon to flow from line 54, into duct 114, through duct 127, and out of end 143. Continued turning of the hand grip 182 will bring sealing surface 176 into proximity to valve seat 120 which will allow the flow of the Halon to be modulated as desired. With pressurized Halon flowing out the nozzle assembly 55, Halon will also flow through holes 150 and into seal 222, "pushing" the lip 223 against surface 142 and preventing external leakage from the disconnect valve half 59. Also, note that the sealing of the shaft 165 is accomplished by the diaphragm seal assembly 166.

Referring now to FIG. 9, still further clockwise rotation of the hand grip 182 will cause sealing surface 176 to contact the seat 120 of the diaphragm assembly 118, sealing off the Halon. Thus, after the fire has been extinguished, Halon flow can be terminated.

Referring now to FIG. 10, it can be seen that the nozzle assembly 55 can be coupled to a nozzle extension assembly, generally designated by numeral 236, having a cone portion 238 for expanding and directing the Halon. The nozzle extension assembly 236 further includes a disconnect valve half 59', similar to the disconnect valve half 59 previously described and illustrated in FIGS. 5–7. The disconnect valve half 59' couples to the disconnect valve half 159 on the nozzle assembly 55 in the manner previoulsy described. The nozzle extension assembly 236, which is normally stored in slot **56*b* in the portable unit 30 (see FIG. 2**), can be used when the fire is within the passenger compartment.

While the fire suppression system has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

INDUSTRIAL APPLICABILITY

The fire suppression system has applicability to transportation vehicles and, in particular, aircraft and ships, as well as industrial plants where a combination of accessible and inaccessible potential fire areas exist.

I claim:

1. An improvement to a fire suppression system for an aircraft, the aircraft having a main compartment and a plurality of subcompartments, the fire suppression system comprising a plurality of ducts having first and second ends, each duct separately coupling a subcompartment to the min compartment, the ducts having a first end coupled to the subcompartment and a second end coupled to the main compartment, and a portable fire extinguisher movable within the main compartment, the improvement comprising:

a first disconnect valve half coupled to each second end of the plurality of ducts; and a nozzle assembly coupled to the fire extinguisher comprising;

a housing having an inlet port and a discharge port coupled by a passageway therebetween;

a second disconnect valve half coupled to said housing mountable with said first disconnect valve half;

a valve seat support located in said passageway having an opening therethrough;

a diaphragm assembly sealing said inlet port from said discharge port, said diagragm assembly having a breakable center portion positioned over said opening and a valve seat conforming to and in contact with said valve seat support;

a shaft mounted within said passageway and translatable therein, said shaft including: a plurality of cutters mounted thereon and a chamfered sealing surface mounted about said cutters adapted to mate with said valve seat; and means to drive said shaft toward said diaphgram assembly such that said cutters pierce said center portion of said diaphragm assembly, thus, connecting said inlet port to said discharge port.

2. The fire suppression system as set forth in claim 1 further including a diaphragm seal mounted within said housing having first and second ends, said first end attached to said housing and said second end attached to said shaft sealing said housing to said shaft.

3. The fire suppression system as set forth in claim 2 wherein said second disconnect valve half comprises:

said housing having an external circumferential groove on the surface of said housing located mounted in proximity to said discharge port;

a constant diameter guide portion at said discharge port end; and a conical surface extending inward from said groove to said constant diameter portion;

a sleeve mounted about said housing, slidable from a first position clear of said groove to a second position extending over said groove; and two-position detent means adapted to releasably lock said sleeve in either said first or second positions.

4. The fire suppression system of claim 3 wherein said first disconnect valve half comprises:

a hollow housing mounted to a wall of the main compartment, said housing having an aperture adapted to engage and position said nozzle assembly within said housing;

a plurality of circumferentially disposed fingers terminating in inwardly directed protrusions mounted within said housing, said protrusions adapted to mate with said groove on said nozzle assembly;

seal means mounted within said housing adapted to seal said constant diameter guide portion of said nozzle assembly when said nozzle assembly is coupled to said first half of said disconnect valve;

such that when said nozzle assembly is coupled to said first disconnect valve half by inserting said constant diameter guide portion into said aperture of said housing, said protrusions contact said conical surface spreading said fingers radially apart until such time as said protrusions enter said groove after which said fingers assume their first position and said sleeve is moved from said second position to said first position.

5. The fire suppression system of claim 3 further including a nozzle extension having a disconnect valve half couplable to said second disconnect valve half on said nozzle assembly such that when a fire occurs in said main compartment said nozzle extension can be attached to said nozzle assembly to aid in the dispersion of said fire suppression chemical on the fire.

* * * * *